United States Patent [19]

Uyehara et al.

[11] 4,450,006

[45] May 22, 1984

[54] MARTENSITIC STAINLESS STEEL

[76] Inventors: Norioki Uyehara, 26-1 Mashida-Kitamachi, Inazawa, Aichi-ken; Susumu Abe, 4-21 Kanazawa-Higashitora, Chita, Aichi-ken; Yasuhiro Kimura, 12-29 Shirasawa-Kitaishine, Agui, Aichi-ken, all of Japan

[21] Appl. No.: 313,671

[22] Filed: Oct. 21, 1981

[30] Foreign Application Priority Data

Oct. 22, 1980 [JP] Japan ..... 55-147791

[51] Int. Cl.[3] ..... C22C 38/16

[52] U.S. Cl. ..... 75/125; 75/126 J; 75/128 N; 148/37

[58] Field of Search ..... 75/125, 126 J, 126 R, 75/126 G, 128 N, 128 G, 128 T, 128 W, 126 C, 126 D, 126 F; 148/37

[56] References Cited

U.S. PATENT DOCUMENTS 2,848,323 8/1958 Harris et al. ..... 75/126 J

FOREIGN PATENT DOCUMENTS 53-52224 5/1978 Japan ..... 75/126 R
54-22242 9/1979 Japan ..... 75/125
849702 9/1960 United Kingdom ..... 75/125

*Primary Examiner*—L. Dewayne Rutledge
*Assistant Examiner*—Debbie Yee
*Attorney, Agent, or Firm*—Armstrong, Nikaido, Marmelstein & Kubovcik

[57] ABSTRACT

Disclosed is an improved martensitic stainless steel, which essentially consisting of 0.15 to 0.50% of C, 0.01 to 0.50% of Si, 0.30 to 2.0% of Mn, 1.0 to 3.0% of Cu, up to 0.20% of Ni, 13.0 to 17.0% of Cr and 0.02 to 0.10% of N, and the balance being Fe and inevitable impurities. The stainless steel can be easily cold pressed as annealed and acquires a high strength when heat treated. Corrosion resistance of the steel is equal to or better than that of a conventional martensitic steel.

5 Claims, 2 Drawing Figures

MARTENSITIC STAINLESS STEEL

BACKGROUND OF INVENTION

1. Field of Invention

The present invention relates to an improved martensitic stainless steel, which can be processed by cold pressing and exhibits a high strength when heat treated.

2. State of the Art

Certain kinds of austenitic, ferritic and martensitic stainless steels are used for production of screws by cold pressing or heading. Some steelmarks are standardized in JIS, and as the martensitic stainless steel, SUS 410 is the most popular one.

In order to enhancing the efficiency of screwing, particularly in the fields of building and automobile production, it is getting more popular to use self-tapping screws which require prepared hole but no tapping because they tap when drove, and self-drilling screws which can even prepare holes simultaneously with tapping. To enable the self-tapping and the self-drilling, the screw should have a high mechanical strength. Conventional steels such as the above mentioned SUS 410 are not competent to these types of use.

Accordingly, there has been a demand for stainless steels of high strength. In general, however, it is a common knowledge that increase of mechanical strength of stainless steels inevitably impairs workability and corrosion resistance thereof.

SUMMARY OF INVENTION

An object of the present invention is to provide a martensitic stainless steel which has a good workability to enable cold pressing but exhibits a high strength after being heat treated so as to stand up to self-tapping and self-drilling.

Another object of this invention is to provide a martensitic stainless steel having not only the above noted physical properties but also corrosion resistance not at all inferior to that of conventional stainless steels.

DRAWINGS

Figure 1:
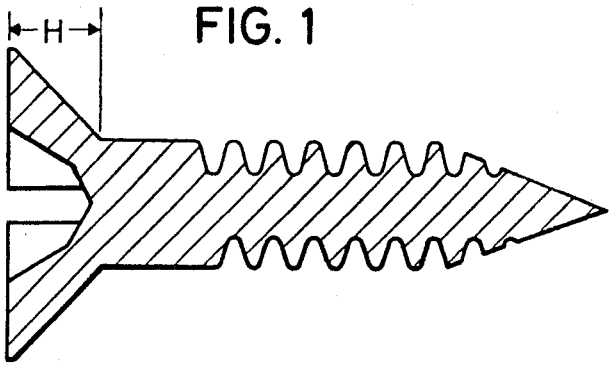
Figure 1:
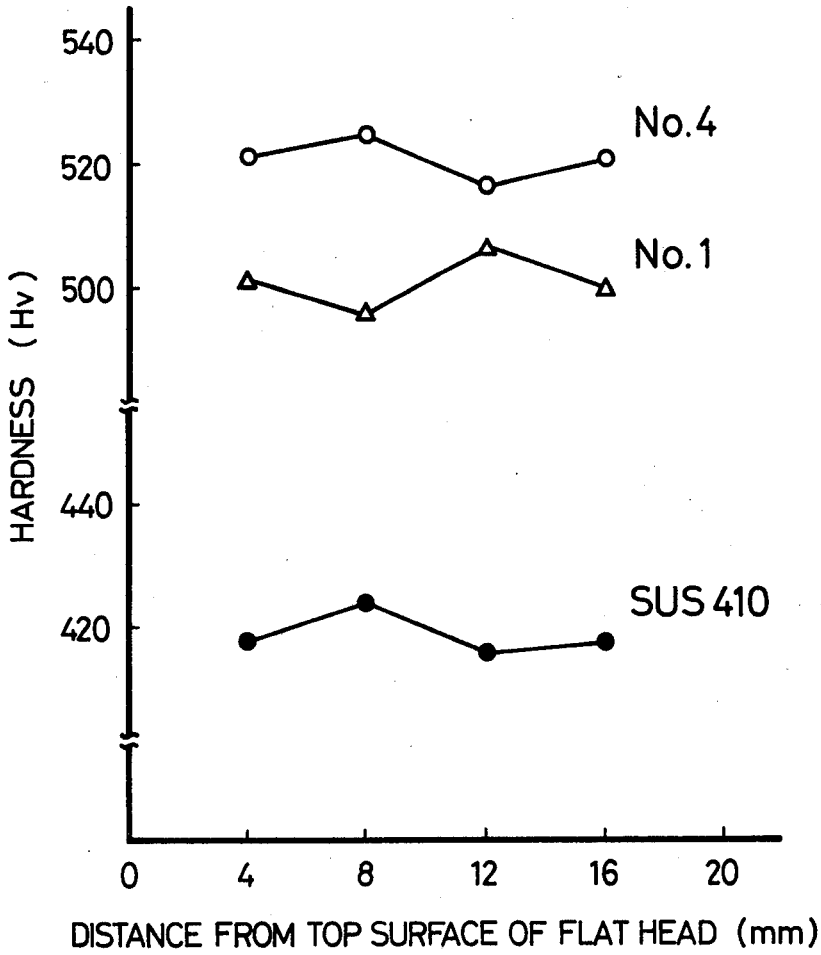

FIG. 1 consists of a profile of a screw made of the martensitic stainless steel according to the present invention, and a graph showing hardness-distribution over various parts of the screw in comparison with that of the screw made of a conventional steel.

Figure 2:
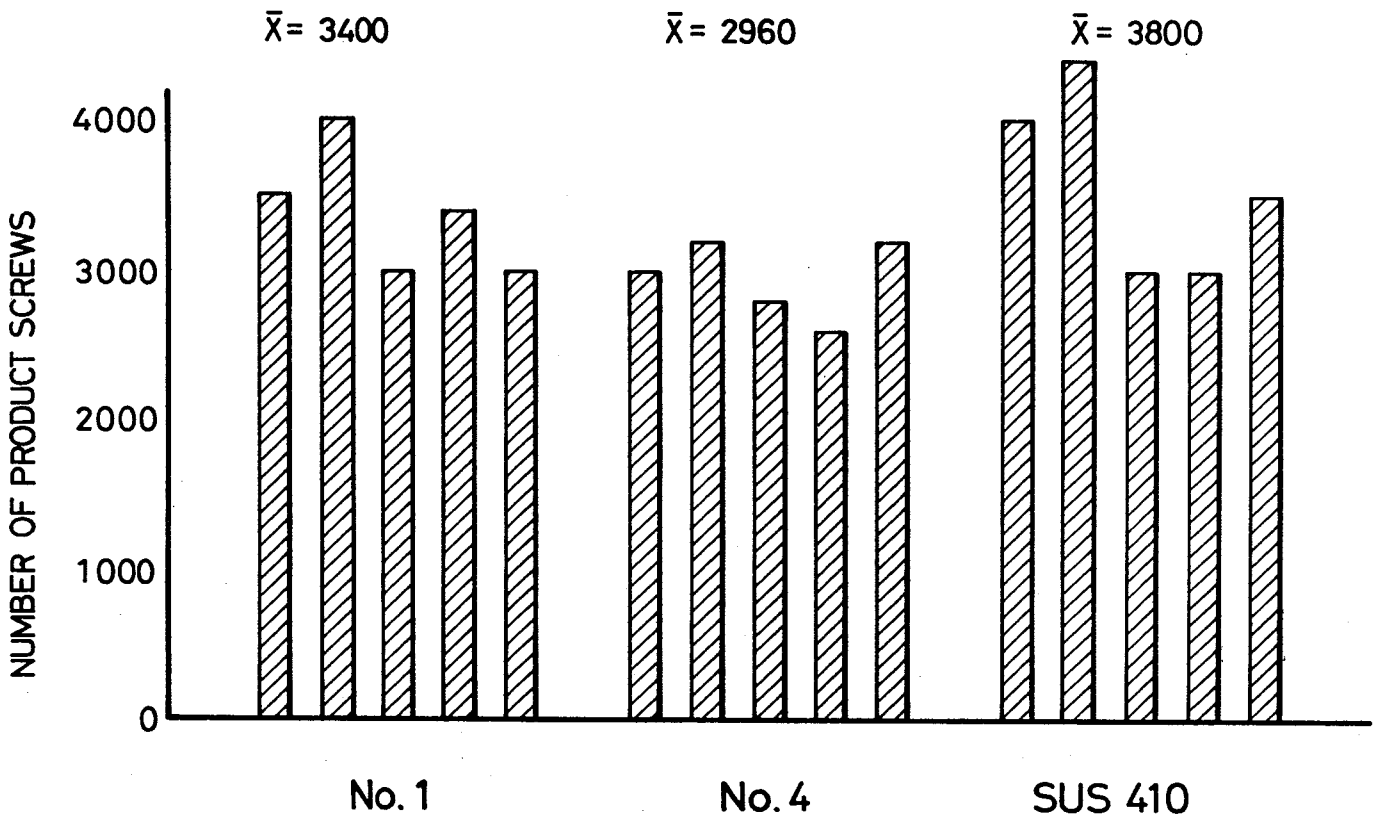

FIG. 2 is a bar graph showing the workability in cold pressing of the present steel expressed by the tool lives in production of the screws, compared with those of the conventional steel.

DETAILED EXPLANATION OF PREFERRED EMBODIMENTS

The martensitic stainless steel of high strength for processing by cold pressing according to the present invention has an alloy composition consist essentially of 0.15 to 0.50% of C, 0.01 to 0.50% of Si, 0.3 to 2.0% of Mn, 1.0 to 3.0% of Cu, up to 0.20% of Ni, 13.0 to 17.0% of Cr and 0.02 to 0.10% of N, and the balance being Fe and inevitable impurities.

The roles of the above noted alloying elements and the significance of the contents thereof will be explained below:

C: 0.15 to 0.50%

Carbon is essential for formation of martensitic structure and carbides to increase the hardness and the strength after hardening and tempering. To ensure the hardness and the strength not lower than those of SUS 410, carbon should be contained in an amount of 0.15% or more. Carbon content higher than 0.50% decreases the workability in cold pressing and corrosion resistance. Preferable range is from 0.20 to 0.30%.

Si: 0.01 to 0.50%

Silicon is added as deoxidizing and desulfurizing agent at the time of preparing the steel, and remains therein.

Because it forms δ-ferrite and impairs the hardness and the strength, content of Si must be at highest 0.50%.

Mn: 0.30 to 2.0%

Manganese is also used for the purpose of deoxidation and desulfurization, and at least 0.30% of Mn remains in the steel. At a content higher than 2.0%, the toughness of the steel decreases, which is not allowable.

Cu: 1.0 to 3.0%

Copper is a useful element to improve the corrosion resistance without heightening the strength after annealing to an extreme level. Conditions under which the screws of high strength are used include environment by air and contact with rain or water dissolving certain amount of salt or so. To obtain sufficient corrosion resistance under such conditions, 1.0% or more of Cu is required. On the other hand, too much copper causes hot cracking, and the upper limit is 3.0%.

Ni: up to 0.20%

Nickel makes annealing difficult and damages workability in cold pressing. Thus, Ni-content should be up to 0.20%.

Cr: 13.0 to 17.0%

For the purpose of ensuring the corrosion resistance, 13.0% or more of Cr is added.

If the content exceeds 17.0%, the hardness and the strength after hardening and tempering decrease due to ferrite formation.

N: 0.02 to 0.10%

To promote the strength due to solution strengthening, 0.02% or more of nitrogen is contained in the present steel. Too high a content reduces the toughness of the steel, and hence the upper limit is 0.10%.

The characteristic feature of the alloy composition of the present steel will be summarized in that, in a martensitic stainless steel, the carbon content is increased so as to obtain a high strength, that anticipated lowering of corrosion resistance due to the high carbon content is compensated, not by increase of Ni-content, but primarily by increase of Cu-content and secondarily by increase of Cr-content so as to facilitate the annealing and to promote the workability in cold pressing, and finally that the strength of the steel is further heightened by a relatively large content of N. Thus, the properties superior to those of SUS 410 were realized.

The stainless steel of the present invention may contain, in addition to the above described basic composition, alloying element or elements selected from one, or any combination of two or even three of the groups mentioned below, if further improvement of the properties is desired.

The following explains the roles of the alloying elements and the significance of the composition:

Mo: 0.5 to 3.0%

Molybdenum improves corrosion resistance. The effect is appeciable at a content of 0.5% or higher, and a content more than 3.0% damages the toughness of the steel.

One, two or more of Ta, Nb, Ti and Zr: 0.01 to 0.10% (In case where two or more is added, total amount)

These elements are useful in preventing coarsening crystal grains during heat treatment or hardening and tempering after the cold pressing. The effect can be expected even at a content as low as 0.01%. At a higher content, saturation of the effect is observed, and the toughness decreases. The upper limit, 0.10%, is decided from these view points.

Rare earth metal or metals: 0.001 to 0.10%, Ca: 0.001 to 0.01%

One or both of them are used. The effects of adding them are substantially identical: perfect desulfurization and heightened toughness. Even such a small amount as 0.001% is effective, and on the other hand, larger amount will cause crack at the cold pressing due to inclusions. In order to avoid the crack, upper limits are decided to be 0.10% for the rare earth metals, and 0.01% for Ca.

Preparation of the present martensitic stainless steel, hot working, annealing, cold pressing, and hardening-tempering thereof may be carried out by employing the technologies which have been applied to conventional steels with slight modifications, if necessary.

EXAMPLE I

Steels of the compositions shown in Table I were prepared and cast, and then rolled to be rods of 20 mm diameter.

In order to determine the workability in cold pressing of the steels, mechanical properties of the sample rods were measured after being annealed. Then, the samples were hardened and tempered, and subjected to tests of mechanical properties and corrosion resistance so as to evaluate the product of this invention.

Conditions of the heat, treatments were as follows:

Annealing: 900° C., furnace cooling

Hardening: 1050° C.×1 hour, oil quenching

Tempering: 300° C.×1 hour, air cooling

The tests of corrosion resistance were carried out under the following conditions:

Wet test: relative humidity 95% or higher, 49° C., 96 hours

Salt Spraying test: 3% NaCl solution, 35° C., 96 hours

For the purpose of comparison, the same tests were made on SUS 410.

The results are shown in Table II.

According to Table II, tensile strength of all the sample steels as annealed does not exceed 65 Kg/mm$^2$, and therefore, they may be easily processed by cold pressing.

With respect to the properties after hardening and tempering, all the samples No. 1 through 5 of the present invention have hardness $H_RC$ exceeding 48. The screw made of these steels can stand screwing without a prepared hole. On the other hand, SUS 410 has $H_RC$ of 42, which level is insufficient for the above purpose.

In the corrosion test there was observed no rust on the present steel, and a good corrosion resistance regardless of increased carbon contents was concluded.

TABLE I

| No. | C | Si | Mn | Cu | Cr | N | Others |
|---|---|---|---|---|---|---|---|
| 1 | 0.25 | 0.05 | 1.00 | 1.50 | 15.5 | 0.03 | — |
| 2 | 0.40 | 0.03 | 1.00 | 2.50 | 16.5 | 0.05 | — |
| 3 | 0.24 | 0.07 | 0.96 | 1.47 | 15.3 | 0.03 | Mo 1.03 |
| 4 | 0.40 | 0.05 | 1.02 | 2.48 | 16.3 | 0.05 | Mo 2.16 |
| 5 | 0.27 | 0.04 | 0.98 | 1.52 | 15.4 | 0.05 | Ti 0.08<br>Ca 0.005 |
| SUS 410 | 0.10 | 0.31 | 0.52 | 0.20 | 13.7 | — | — |

TABLE II

| | As Annealed | | After Hardening and Tempering | | | |
|---|---|---|---|---|---|---|
| No. | Tensile Strength (Kg/mm$^2$) | Hardness ($H_RB$) | Tensile Strength (Kg/mm$^2$) | Hardness ($H_RC$) | Wet Test* | Salt Spraying Test* |
| 1 | 62 | 89 | 166.5 | 49.0 | A.A | A.A |
| 2 | 65 | 92 | 183.0 | 52.0 | A.A | A.A |
| 3 | 61 | 87 | 163.1 | 48.2 | A.A | A.A |
| 4 | 65 | 93 | 185.0 | 53.2 | A.A | A.A |
| 5 | 63 | 90 | 170.4 | 50.2 | A.A | A.A |
| SUS 410 | 53 | 83 | 137.0 | 42.0 | A.A | A.A |

*Grade A means "no rust". (Two Samples)

EXAMPLE II

Samples No. 1 and No. 4 prepared in Example I, and SUS 410 were prosessed to be screws. The materials were drawn to wires of diameter 3.22, and the wires were cold pressed or headed to the flat-headed screws (nominal diameter: 3.5) of crossed grooves, profile of the screw is shown in the upper part of FIG. 1.

Survey was made on the tool life, hardness-distribution and corrosion-resistance of the product screws.

Criterion of the tool life is the number of screws produced with it until the length of "H" in FIG. 1 becomes out of the product standard, $(2_{-0.03}{}^{+0})$ mm.

A part of the data obtained are expressed by a bar graph in FIG. 2. The materials according to the present invention exhibit workability in cold pressing or heading, though not so high as that of SUS 410, sufficiently good from practical view points.

The hardness-distribution is shown with the line graph in FIG. 1. It is clear that the screws made of the present steel is very hard, and can stand self-tapping or self-drilling.

The corrosion resistance was measured by subjecting the screws to the same testing conditions as used in Example I. Table III shows the test results on 100 screws. Sample No. 4 has a particularly good corrosion resistance, which is considered to be due to addition of Mo.

TABLE III

| | Wet Test | | Salt-Spraying Test | |
|---|---|---|---|---|
| No. | A | B | A | B |
| 1 | 100 | 0 | 98 | 2 |
| 4 | 100 | 0 | 100 | 0 |
| SUS 410 | 100 | 0 | 90 | 10 |

Evaluation A means "no rust", and B, "slight rust".

What is claimed is:

1. A martensitic stainless steel of high mechanical strength and suitable for processing by cold pressing, which steel consist of 0.20 to 0.50% of C, 0.01 to 0.50% of Si, 0.30 to 2.0% of Mn, 1.0 to 3.0% of Cu, up to 0.20% of Ni, 13.0 to 17.0% of Cr and 0.02 to 0.10% of N, and the balance being Fe and inevitable impurities.

2. A martensitic stainless steel of claim 1, wherein the steel further contains 0.50 to 3.0% of Mo.

3. A martensitic stainless steel of claim 1, wherein the steel further contains 0.01 to 0.10% of at least one member of Ta, Nb, Ti and Zr.

4. A martensitic stainless steel of claim 1, wherein the steel further contains 0.001 to 0.10% of a rare earth metal or metals.

5. A martensitic stainless steel of claim 1, wherein the steel further contains 0.001 to 0.01% of Ca.

* * * * *